US008047838B2

(12) United States Patent
Chever et al.

(10) Patent No.: US 8,047,838 B2
(45) Date of Patent: Nov. 1, 2011

(54) COOLED ROLLER FOR HANDLING IRON AND STEEL PRODUCTS

(75) Inventors: René-Vincent Chever, Brou sur Chantereine (FR); Daniel Simonetti, Draveil (FR)

(73) Assignee: Stein Heurtey, Ris Orangis (FR)

( * ) Notice: Subject to any disclaimer, the term of this patent is extended or adjusted under 35 U.S.C. 154(b) by 825 days.

(21) Appl. No.: 11/910,838

(22) PCT Filed: Mar. 24, 2006

(86) PCT No.: PCT/FR2006/000657

§ 371 (c)(1),
(2), (4) Date: Mar. 31, 2008

(87) PCT Pub. No.: WO2006/106203

PCT Pub. Date: Oct. 12, 2006

(65) Prior Publication Data

US 2008/0171298 A1 Jul. 17, 2008

(30) Foreign Application Priority Data

Apr. 7, 2005 (FR) ..... 05 03476

(51) Int. Cl.
*B21B 27/06* (2006.01)

(52) U.S. Cl. ..... 432/246; 219/469

(58) Field of Classification Search ..... 432/60, 432/228, 246; 219/216, 469, 470; 492/46; 399/328

See application file for complete search history.

(56) References Cited

U.S. PATENT DOCUMENTS

| | | | | |
|---|---|---|---|---|
| 3,965,974 | A * | 6/1976 | Sernetz et al. | 164/448 |
| 4,395,109 | A * | 7/1983 | Nakajima et al. | 219/216 |
| 5,230,618 | A * | 7/1993 | Bricmont et al. | 432/236 |
| 5,362,230 | A * | 11/1994 | Facco | 432/236 |
| 5,370,530 | A * | 12/1994 | Facco | 432/236 |
| 5,421,724 | A * | 6/1995 | Facco | 432/236 |
| 6,432,030 | B1 * | 8/2002 | Miller | 492/30 |
| 6,435,867 | B1 * | 8/2002 | Carr et al. | 432/236 |
| 6,907,219 | B2 * | 6/2005 | Kim et al. | 399/328 |
| 6,969,252 | B2 * | 11/2005 | Nagafuji | 432/60 |
| 7,578,380 | B2 * | 8/2009 | Brinkmeier et al. | 193/37 |
| 2004/0126728 | A1 * | 7/2004 | Nagafuji | 432/60 |
| 2010/0239991 | A1 * | 9/2010 | Bryan | 432/11 |

FOREIGN PATENT DOCUMENTS

EP 0345147 A 12/1989

* cited by examiner

*Primary Examiner* — Gregory A Wilson

(74) *Attorney, Agent, or Firm* — Connolly Bove Lodge & Hutz LLP

(57) ABSTRACT

The invention concerns a roller (R), used in continuous product heating furnaces for handling and conveying steel products and in particular slabs. The associated apparatus includes a cooled central shaft (1), cooled by a liquid. On the shaft are mounted a plurality of discs (2), for supporting the products (3) to be transported, arranged perpendicularly to the longitudinal geometrical axis of the roller (R), spaced apart along the axis of the roller (R) and separated by an insulating sleeve (4). The insulating sleeve (4) is maintained at each longitudinal end by at least one cold component (5) secured to the shaft (1) and cooled by the shaft, with axial play (Ja) between the sleeve (4) and the shaft (1) such that possible sagging of the shaft (1) may occur in use without causing substantial mechanical stress on the insulating sleeve (4) and the heat transferred from the sleeve (4) to the shaft (1), and from the discs (2) to the sleeve (4) is limited.

12 Claims, 3 Drawing Sheets

COOLED ROLLER FOR HANDLING IRON AND STEEL PRODUCTS

CROSS REFERENCE TO RELATED APPLICATIONS

This application is a National Phase filing under 35 U.S.C. §371 of PCT/FR2006/000657 filed Mar. 24, 2006, which claims priority to Patent Application No. 0503476, filed in France on Apr. 7, 2005. The entire contents of each of the above-applications are incorporated herein by reference.

BACKGROUND OF THE INVENTION

The present invention relates to a roller used in particular in continuous furnaces for heating long products, for handling and conveying iron and steel products, particularly slabs.

It is known that this type of roller must be designed and manufactured in such a way that it is suitable for:

- the nature and characteristics of the products moving in the furnace, particularly as regards weight, dimensions, shape, etc.
- the ambient thermal conditions in the furnace, which depend on the temperature to which the product has to be heated,
- the nature of the atmosphere (oxidizing or reducing) in the furnace,
- the range of speeds at which the product has to be moved in the furnace.

These handling and conveying rollers must also be designed and manufactured in such a way that they guide the products correctly throughout the furnace while limiting the thermal marking of the products.

Additionally, the life of the rollers during which they retain their initial performance level must be sufficiently long compared with the other mechanical components of the furnace.

EP 0,345,147 describes a roller consisting of a cooled central shaft having a plurality of discs perpendicular to the geometric axis of the said shaft, each of these discs being provided with a tread in contact with the product being moved in the furnace, the discs being separated by insulating sleeves.

This technique, like all those used at the present time, is not entirely satisfactory, particularly because of the excessively limited life of the roller, due to the deterioration of the insulating sleeves caused by the mechanical stresses imparted by the deflection movements of the central shaft during the passage of the products. Thermal stresses also contribute to the deterioration of the insulating sleeves.

BRIEF SUMMARY OF THE INVENTION

The object of the invention is, especially, to propose a technical solution which can substantially reduce the mechanical stresses, and preferably also the thermal stresses, on the insulating sleeves.

According to the invention, a roller, used in particular in continuous furnaces for reheating long products, for handling and conveying iron and steel products, particularly slabs, comprising a central shaft which is cooled, particularly by a liquid, on which are mounted a plurality of discs serving to support the products to be conveyed, positioned perpendicularly to the longitudinal geometrical axis of the roller, spaced apart along the axis of the roller, and separated by insulating sleeves, is characterized in that each insulating sleeve is retained at each longitudinal end by at least one cold part fixed to the shaft and cooled by the shaft, with an axial clearance between the sleeve and the cold part, and a radial clearance between the sleeve and the shaft, such that any deflection of the shaft can occur during operation without causing any substantial mechanical stress on the insulating sleeve, and the heat transfer from the sleeve to the shaft, and from the discs to the sleeve, is limited.

According to a first possibility, the sleeve is supported radially at each axial end by a cold part.

According to another possibility, the sleeve is supported radially by the shaft.

The cold part can be separate from the neighbouring disc. The areas of contact between the insulating sleeve and the cold parts are limited to the axial end areas of the sleeve, in such a way that these reduced areas of contact and the clearance between the insulating sleeve and the cold parts limit the transfer of heat from the sleeve to the cold parts.

The cold part can consist of a shouldered ring or at least two stops locked with respect to translation and rotation on the central shaft. The ring or stop can be locked by welding to the shaft. The cold part can also consist of a part for locking with respect to translation and rotation of a disc which can be mounted with a radial clearance on the shaft so that it is free with respect to rotation and translation.

An intermediate radial space can be provided between the shaft and the inner cylindrical surface of the insulating sleeve; the outer cylindrical surface of the insulating sleeve can be free.

The inner cylindrical surface of the insulating sleeve can consist of a metal cylindrical skirt around which an insulating material, particularly refractory concrete, is cast. As a variant, the sleeve can consists of a series of cylindrical metal screens separated by air spaces.

The rectilinear generatrices of the cylindrical skirt can extend axially over the cold parts, which radially support the skirt and the sleeve, the skirt having an inside diameter exceeding the outside diameter of the shaft by an amount determining the radial dimension of the intermediate space; a ring projecting radially inwards, in a plane orthogonal to the geometrical axis of the shaft, is provided inside the skirt, towards each of its axial ends and on the side of each cold part opposite the neighbouring disc; and the axial clearance and the radial clearance are provided, on the one hand, between the cold part and the neighbouring face of the ring, and, on the other hand, between the shaft and the diameter of the opening of the ring surrounding the shaft.

In a variant, the radial clearance is provided between the inside diameter of the skirt and the outside diameter of the shaft, and the axial ends of the skirt have a radial outward recess followed by an axial cylindrical return, the skirt is supported radially by the shaft, and the axial clearance is provided between the opposing faces of the cold part and the recess.

The insulating sleeve can be mounted so that it is freely rotatable on the shaft.

BRIEF DESCRIPTION OF THE DRAWINGS

Other characteristics and advantages of the invention will be made clear in the following description, which refers to the attached drawings but has no restrictive intent.

In these drawings.

DETAILED DESCRIPTION OF THE INVENTION

Figure 1:
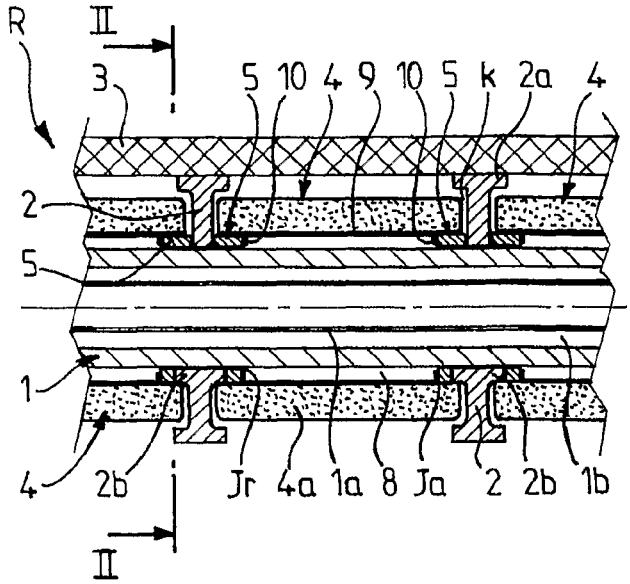
FIG. 1 is a longitudinal section, taken along the line I-I of FIG. 2, of a roller according to a first embodiment of the invention.
Figure 2:
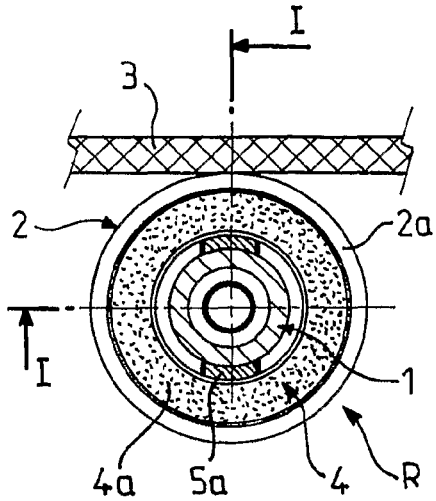
FIG. 2 is a section through the roller taken along the line II-II of FIG. 1.
Figure 3:
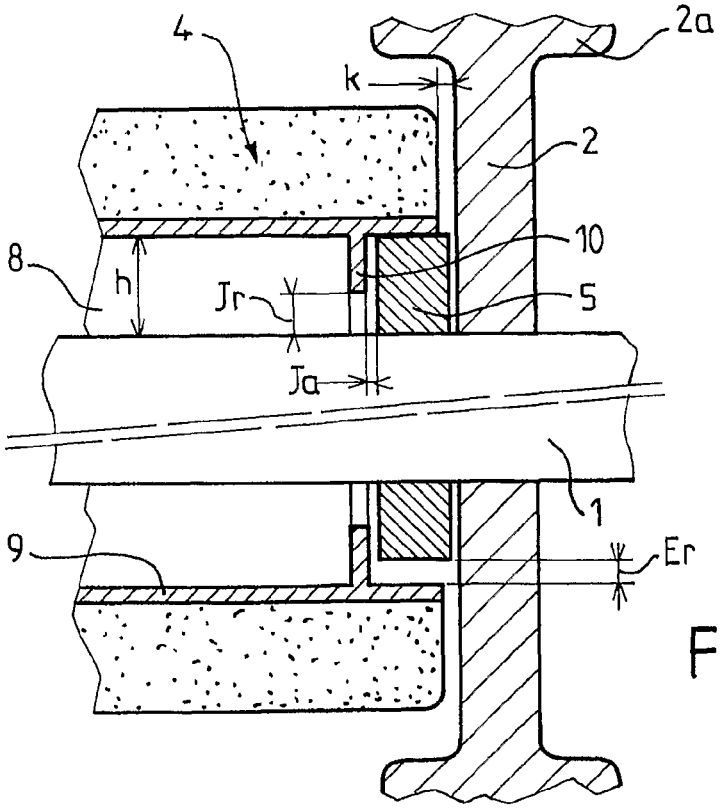
FIG. 3 is a detail of parts of the roller of FIG. 1, on a larger scale.

Referring to FIGS. 1 to 3, it can be seen that a roller R according to the invention comprises a hollow central shaft 1 having a substantially horizontal geometrical axis, on which are mounted discs 2, which serve to support iron and steel products 3 to be conveyed, for example slabs at a relatively high temperature, particularly of the order of 1000° C. or more, passing through a reheating furnace which is not shown. The hollow shaft 1 has inside it a coaxial tube 1*a* forming an annular space 1*b* between its outer surface and the inner surface of the shaft 1. The shaft 1 is cooled by a flow of water, for example one which is delivered to the annular space 1*b* and returns through the tube 1*a*.

The discs 2 are positioned perpendicularly to the longitudinal axis of the roller R, and are spaced along this axis. Two successive discs 2 are separated by a cylindrical insulating sleeve 4. The periphery of each disc 2 forms a tread 2*a* in contact with the product 3. This tread 2*a* extends on both sides of the median plane of the disc 2. The disc 2 has a guide collar 2*b* next to the shaft 1, the axial extension of this collar being optimized for the efficient guiding of the disc 2 on the shaft 1. The inside diameter of the collar 2*b* slightly exceeds the outside diameter of the shaft 1, by an amount which enables the discs 2 to be mounted on the shaft 1 so that they are free with respect to rotation and translation. The discs 2 are not directly fixed to the shaft 1. There is an air interface between the collar 2*b* and the shaft 1 over the greater part of the circumference, and this retards the transmission of heat from the disc 2 to the shaft 1.

The insulating sleeve 4 forms a complete volume of revolution about the axis of the roller, permitting the production of a simple and robust component, advantageously from the refractory concrete.

The insulating sleeve 4 is retained at each longitudinal end by at least one cold part 5 with an axial clearance Ja (FIG. 3) and a radial clearance Jr (FIG. 3) between the sleeve 4 and the shaft 1. The clearances Ja and Jr permit any necessary deflection of the shaft 1 during operation, without causing any significant mechanical stress on the sleeve 4. The values of the clearances Ja and Jr are determined according to the operating conditions and the dimensions of the rollers. For guidance, but without restrictive intent, the clearances Ja and Jr are generally greater than two millimeters.

In the embodiments of FIGS. 1 to 3 and FIGS. 6 and 7, the sleeve 4 is supported radially by the cold part 5. There is a radial clearance Er between the sleeve 4 and the part 5. The clearance Er is preferably less than half of the radial clearance Jr between the sleeve 4 and the shaft 1.

As shown in the drawings, the sleeve 4 can be formed from an assembly of a plurality of parts fixed together. The clearances are to be considered between the cold part 5, the shaft 1, and the nearest surface of the fixed part of the sleeve 4.

The cold part 5 can be separate from the neighbouring disc 2, in such a way that a continuity solution is formed between them and creates a thermal barrier. In operation, the part 5, cooled by conduction by the shaft 1 and separated from the disc 2, is at a temperature which is substantially lower than that of the neighbouring disc 2.

The longitudinal ends of the sleeve 4 are spaced apart axially from the neighbouring discs 2 by a distance k, equal to at least twice Ja, in such a way that the insulating sleeve 4 is not in contact with the hot discs 2. The thermal and mechanical stresses on the sleeve 4 are thereby reduced.

With the same purpose of limiting the heat exchange, the provision of reduced areas of contact at the axial ends of the sleeve, particularly by introducing radial and axial clearances between the insulating sleeve 4 and the cold parts 5, makes it possible to limit the heat transfer from the insulating sleeve 4 towards the cold parts 5.

Each cold part 5 can consist of a shouldered ring 6 (FIG. 4) or at least two stops 7 (FIG. 5) locked with respect to translation and rotation on the central shaft 1. The locking can be achieved by welding the ring 6 or stop 7, made from a weldable steel, to the shaft 1. The welding also ensures that the parts 5 are cooled by conduction.

Figure 4:
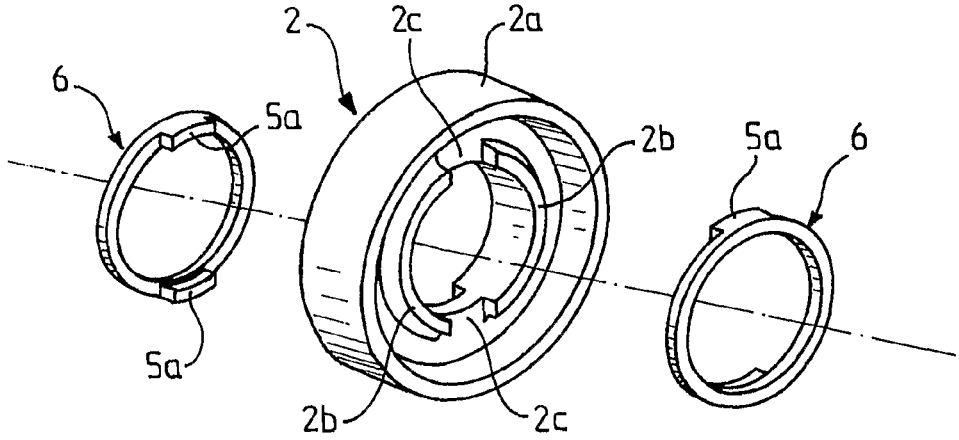
FIG. 4 is an exploded perspective view of elements of the roller of FIG. 1.
Figure 5:
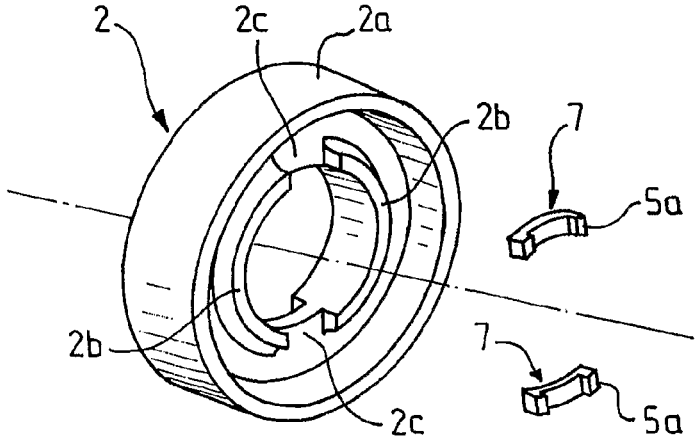
FIG. 5 is an exploded perspective view of another embodiment of the elements of FIG. 4.
Figure 6:
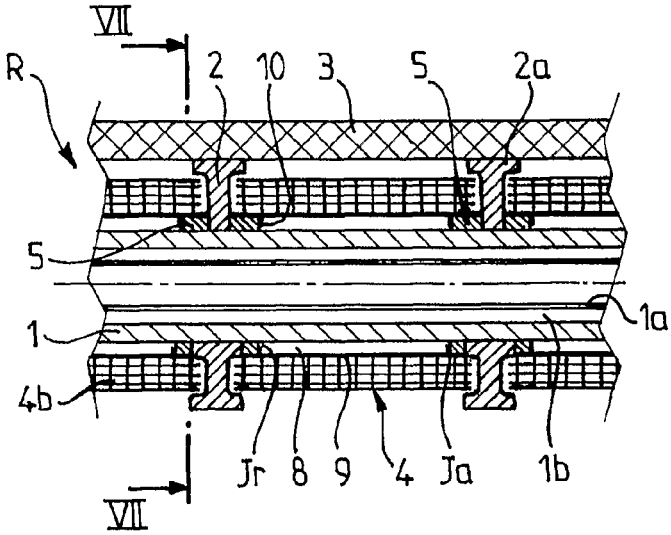
FIG. 6 is a longitudinal section, taken along the line VI-VI of FIG. 7, of a roller according to a second embodiment of the invention.
Figure 7:
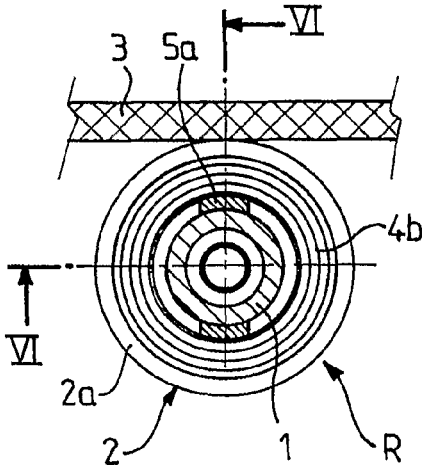
FIG. 7 is a section through the roller taken along the line VII-VII of FIG. 6.

Advantageously, the cold parts 5 also serve to fix the disc 2 to the shaft 1 with respect to translation and rotation. For this purpose, the cold parts 5 have axially projecting shoulders which can engage in corresponding cut-outs provided in the collars 2*b* of the discs 2. Two diametrically opposed cut-outs 2*c* are shown in FIGS. 4 and 5. It is possible to provide more of these, particularly three, spaced at angular intervals of 120°.

Since the discs 2 are mounted on the shaft with a radial clearance, this clearance allows the discs 2 to expand freely with respect to the central shaft 1, thus also eliminating the thermomechanical stresses between these parts.

An intermediate space 8 can be provided between the shaft 1 and the insulating sleeve 4.

The insulating sleeve 4 can comprise an inner cylindrical metal skirt 9 surrounded by, and fixed to, a cast shell of refractory concrete 4*a* (FIGS. 1 to 3) whose outer surface is free, or formed by a succession of metal screens 4*b* (FIGS. 6 and 7) separated by air spaces. The metal screens 4*b* oppose heat transfer by radiation between the furnace atmosphere and the cooled shaft 1 of the roller R.

In the embodiments of FIGS. 1 to 3 and FIGS. 6 and 7, the rectilinear generatrices of the cylindrical skirt 9 extend axially (see FIG. 3) over the cold parts 5, which radially support the skirt 9 and the sleeve 4. The skirt 9 has an inside diameter exceeding the outside diameter of the shaft 1 by an amount h determining the radial dimension of the space 8. Inside the skirt 9, towards each of its axial ends and on the side of each stop means 5 opposite the neighbouring disc 2, there is provided a ring 10, projecting radially inwards, in a plane orthogonal to the geometrical axis. The aforementioned clearances Ja and Jr are provided, on the one hand, between the cold part 5 and the neighbouring face of the ring 10, and, on the other hand, between the shaft 1 and the diameter of the opening of the ring 10 surrounding the shaft 1.

Figure 8:
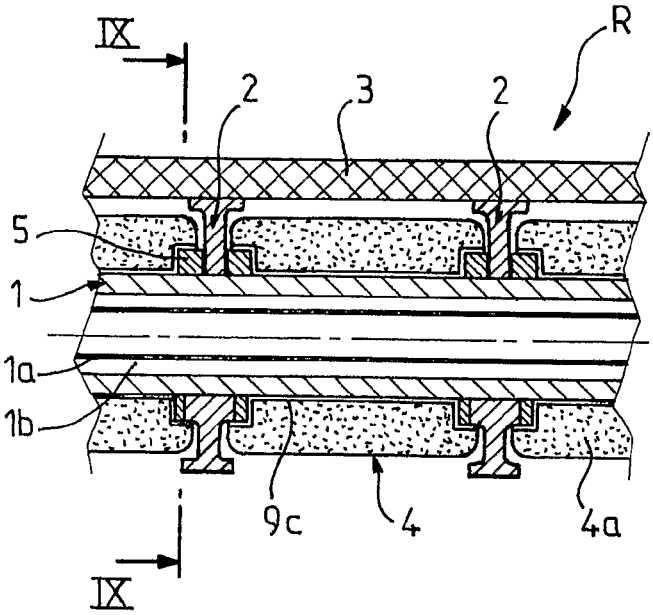
FIG. 8 is a longitudinal section, taken along the line VIII-VIII of FIG. 9, of a roller according to a third embodiment of the invention.
Figure 9:
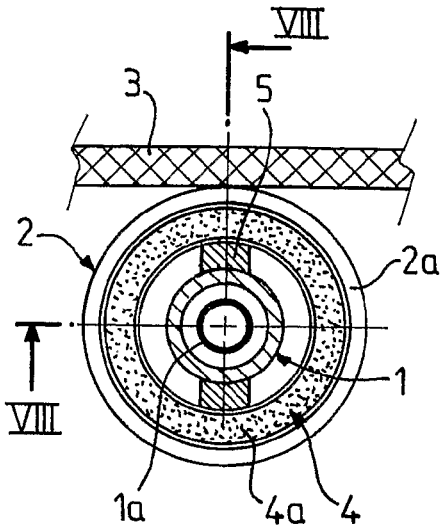
FIG. 9 is a section through the roller taken along the line IX-IX of FIG. 8.
Figure 10:
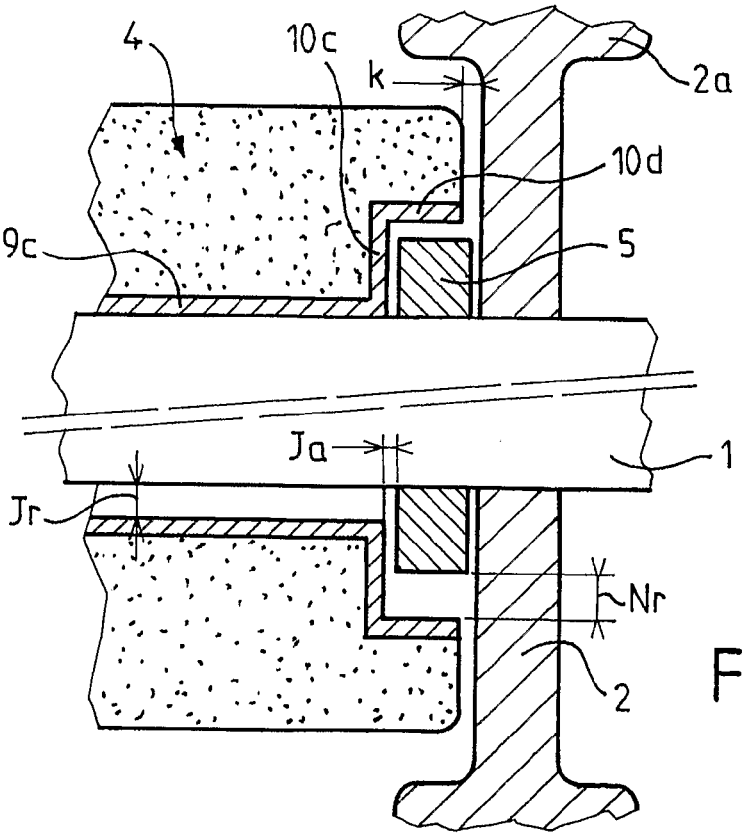
FIG. 10 is a detail of parts of the roller of FIG. 8, on a larger scale.

FIGS. 8 to 10 show another embodiment of a roller R according to the invention, in which the intermediate space 8 of FIG. 3 is eliminated. The insulating sleeve 4 also comprises an inner cylindrical metal skirt 9*c* surrounded by, and fixed to, an insulating sleeve 4*c*, made for example from refractory concrete. The radial clearance Jr is provided between the inside diameter of the skirt 9*c* and the outside diameter of the shaft 1, which radially supports the skirt 9*c* and the sleeve 4. The axial ends of the skirt 9*c* have an outward facing radial recess 10*c*, followed by an axial cylindrical return 10*d* which fits on top of the cold part 5. The axial clearance Ja is provided between the opposing faces of the cold part 5 and the recess 10*c*. There is a clearance Nr, equal to at least twice the clearance Jr between the shaft 1 and the sleeve, between the part 5 and the sleeve 4/skirt 9*c*.

The insulating sleeve 4 can be mounted in a freely rotatable way on the shaft 1, without being driven by the ring 6 or the stops 7.

The operation of the roller R is explained below. When a slab 3 passes, the shaft 1 can undergo a deflection which will decrease the clearances Ja and/or Jr without eliminating them altogether, so that the sleeves 4 are protected from the mechanical and thermal stresses.

The invention claimed is:

1. Roller, used in particular in continuous furnaces for reheating long products, for handling and conveying iron and steel products, particularly slabs, comprising a cooled central shaft on which are mounted a plurality of discs serving to support the products to be conveyed, positioned perpendicularly to the longitudinal geometrical axis of the roller, spaced apart along the axis of the roller and separated by insulating sleeves, wherein the insulating sleeve is retained at each longitudinal end by at least one cold part fixed to the shaft and cooled by the shaft, with an axial clearance between the sleeve and the cold part, wherein the cold part consists of at least two stops locked with respect to rotation and translation on the central shaft, and a radial clearance between the sleeve and the shaft, such that any deflection of the shaft can occur during operation without causing any substantial mechanical stress on the insulating sleeve, and the heat transfer from the sleeve to the shaft, and from the discs to the sleeve, is limited; and wherein the axial clearance and the radial clearance are respectively greater than two millimeters.

2. Roller according to claim 1, wherein the sleeve is supported radially at each axial end by a cold part.

3. Roller according to claim 2, wherein the areas of contact between the insulating sleeve and the cold parts are limited to the axial end areas of the sleeve, in such a way that these reduced areas of contact and the clearance between the insulating sleeve and the cold parts limit the transfer of heat from the sleeve to the cold parts.

4. Roller according to claim 1, wherein the sleeve is supported radially by the shaft.

5. Roller according to claim 1, wherein the cold part is separate from the neighbouring disc.

6. Roller according to claim 1, wherein the cold part, welded to the cooled shaft, also forms a part for stopping the translation and rotation of a disc.

7. Roller according to claim 6, wherein the disc is mounted with a radial clearance on the shaft, and is free with respect to rotation and translation.

8. Roller according to claim 1, wherein it has an intermediate space between the shaft and the insulating sleeve.

9. Roller, used in particular in continuous furnaces for reheating products, for handling and conveying iron and steel products, particularly slabs, comprising:

a cooled central shaft on which are mounted a plurality of discs serving to support the products to be conveyed, positioned perpendicularly to the longitudinal geometrical axis of the roller, spaced apart along the axis of the roller and separated by insulating sleeves, wherein the insulating sleeve is retained at each longitudinal end by at least one cold part fixed to the shaft and cooled by the shaft, with an axial clearance between the sleeve and the cold part, and a radial clearance between the sleeve and the shaft, such that any deflection of the shaft can occur during operation without causing any substantial mechanical stress on the insulating sleeve, and the heat transfer from the sleeve to the shaft, and from the discs to the sleeve, is limited; wherein the axial clearance and the radial clearance are respectively greater than two millimeters; wherein the insulating sleeve comprises an inner cylindrical metal skirt, a refractory concrete shell cast around the cylindrical skirt, a succession of cylindrical metal screens separated by air spaces, and wherein rectilinear generatrices of the cylindrical skirt extend axially over the cold parts, which radially support the skirt and the sleeve; wherein the skirt has an inside diameter exceeding the outside diameter of the shaft by an amount determining the radial dimension of the intermediate space; and a ring projecting radially inwards, in a plane orthogonal to the geometrical axis of the shaft, is provided inside the skirt, towards each of its axial ends and on the side of each cold part opposite the neighbouring disc, the clearances being provided, on the one hand, between the cold part and the neighbouring face of the ring, and, on the other hand, between the shaft and the diameter of the opening of the ring surrounding the shaft.

10. Roller according to claim 9, wherein the sleeve is supported radially by the shaft, the radial clearance is provided between the inside diameter of the skirt and the outside diameter of the shaft, and each axial end of the skirt has an outward facing radial recess followed by an axial cylindrical return, the axial clearance being provided between the opposing faces of the cold part and the recess.

11. Roller according to claim 9, wherein the cold part consists of a shouldered ring locked with respect to rotation and translation on the central shaft.

12. Roller according to claim 9, wherein the cold part consists of at least two stops locked with respect to rotation and translation on the central shaft.

* * * * *